US011063377B2

(12) United States Patent
Toda

(10) Patent No.: US 11,063,377 B2
(45) Date of Patent: Jul. 13, 2021

(54) MULTI-CABLE CONNECTOR WITH CABLE PIERCING TERMINALS

(71) Applicant: Japan Aviation Electronics Industry, Limited, Tokyo (JP)

(72) Inventor: Kentaro Toda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 16/837,285

(22) Filed: Apr. 1, 2020

(65) Prior Publication Data

US 2020/0395694 A1 Dec. 17, 2020

(30) Foreign Application Priority Data

Jun. 13, 2019 (JP) ..... JP2019-110501

(51) Int. Cl.

| | |
|---|---|
| ***H01R 12/67*** | (2011.01) |
| ***H01R 4/24*** | (2018.01) |
| ***H01R 12/51*** | (2011.01) |
| ***H01R 12/59*** | (2011.01) |

(52) U.S. Cl.

CPC ..... *H01R 12/515* (2013.01); *H01R 4/24* (2013.01); *H01R 12/592* (2013.01); *H01R 12/67* (2013.01)

(58) Field of Classification Search

CPC .... H01R 12/515; H01R 12/592; H01R 12/67; H01R 12/675; H01R 4/24; H01R 4/2416; H01R 4/242

See application file for complete search history.

(56) References Cited

U.S. PATENT DOCUMENTS

| | | | | |
|---|---|---|---|---|
| 5,536,182 A * | 7/1996 | Atoh | H01R 12/675 | 439/404 |
| 5,554,047 A * | 9/1996 | Englert, Jr. | H01R 12/675 | 439/405 |
| 5,833,486 A * | 11/1998 | Shinozaki | H01R 12/675 | 439/404 |
| 6,068,504 A * | 5/2000 | Gardner | H01R 12/675 | 439/405 |

(Continued)

FOREIGN PATENT DOCUMENTS

| | | |
|---|---|---|
| CN | 204333365 U | 5/2015 |
| CN | 204927571 U | 12/2015 |

(Continued)

*Primary Examiner* — Vanessa Girardi

(74) *Attorney, Agent, or Firm* — Collard & Roe, P.C.

(57) ABSTRACT

A connector is provided with a plurality of terminals and a housing. The terminals include a first terminal corresponding to a first cable and a second terminal corresponding to a second cable. Each of the terminals has a contact portion, a held portion and a connection portion. The contact portion is brought into contact with a mating contact portion when the connector is connected to a mating connector. The held portion is held by the housing. When the connector is attached to a composite cable, the connection portion pierces a covering portion of a cable corresponding thereto and is connected to a conductor of the cable. The connection portion of the first terminal protrudes from the held portion in a front-rear direction. The connection portion of the second terminal protrudes from the held portion in a perpendicular direction.

12 Claims, 7 Drawing Sheets

(56) References Cited

U.S. PATENT DOCUMENTS

| | | | | |
|---|---|---|---|---|
| 6,077,105 | A * | 6/2000 | Jochen | H01R 12/675 439/405 |
| 6,857,894 | B2 | 2/2005 | Riku | |
| 9,799,966 | B2 | 10/2017 | Tsai et al. | |
| 10,348,032 | B2 | 7/2019 | Yamaguchi et al. | |

FOREIGN PATENT DOCUMENTS

| | | | |
|---|---|---|---|
| CN | 105529554 | A | 4/2016 |
| JP | 2004152667 | A | 5/2004 |
| JP | 2006156148 | A | 6/2006 |
| JP | 2011034876 | A | 2/2011 |
| JP | 2018152244 | A | 9/2018 |
| KR | 20160126171 | A | 11/2016 |
| KR | 101770506 | B1 | 8/2017 |

* cited by examiner

MULTI-CABLE CONNECTOR WITH CABLE PIERCING TERMINALS

CROSS REFERENCE TO RELATED APPLICATIONS

This application is based on and claims priority under 35 U.S.C. § 119 to Japanese Patent Application No. JP2019-110501 filed Jun. 13, 2019, the contents of which are incorporated herein in their entirety by reference.

BACKGROUND OF THE INVENTION

This invention relates to a connector, particularly, to a connector to be attached to a composite cable.

JP2004-152667A (Patent Document 1) discloses an example of a connector to be attached to a plurality of cables. As shown in FIG. 11, a connector 90 of Patent Document 1 has a housing 92 and a block 94 which is combined with the housing 92. The block 94 is attached to the housing 92 from above of the housing 92. The block 94 is formed with a plurality of receiving holes 940 which receive end portions (not shown) of the cables (not shown), respectively.

As understood from FIGS. 11 and 12, the housing 92 is provided with a plurality of contacts 920 which correspond to the cables (not shown), respectively. As shown in FIG. 12, each of the contacts 920 has a contact portion 922 to be brought into contact with a mating contact (not shown) of a mating connector (not shown). The contact 920 further has a connection portion 924 to be connected to the cable corresponding thereto. In a state that the housing 92 and the block 94 are combined with each other, the connection portion 924 protrudes into the receiving hole 940.

As understood from FIG. 12, when the block 94 is attached to the housing 92 from above the housing 92 in a state that the end portions (not shown) of the cables (not shown) are received in the receiving holes 940, the connection portions 924 cut into the cables. As a result, the connection portions 924 pierce covering portions (not shown) of the cables and reach conductors (not shown) of the cables, respectively. Thus, the connector 90 is attached to the cables.

SUMMARY OF THE INVENTION

In order to attach the connector 90 of Patent Document 1 to the plurality of the cables, the cables must be inserted into the receiving holes 940 of the block 94 independently. Accordingly, the connector of Patent Document 1 is unsuitable for automatization of being attached to the cables.

In addition, the connector 90 of Patent Document 1 is formed so as to be attached to the same cables. Accordingly, the connector 90 of Patent Document 1 is unsuitable for being attached to a composite cable which has different cables different from each other in diameter, such as signal cables and power cables.

It is therefore an object of the present invention to provide a connector which has a structure suitable for automatization of being attached to a composite cable.

One aspect of the present invention provides a connector to be attached to a composite cable having a plurality of cables. The connector is connectable to and detachable from a mating connector having mating contact portions along a front-rear direction. The connector comprises a plurality of terminals and a housing. The terminals correspond to the cables, respectively. Each of the cables has a conductor and a covering portion covering the conductor. Each of the terminals has a contact portion, a held portion and a connection portion. The contact portion is brought into contact with one of the mating contact portions when the connector is connected to the mating connector. The held portion is held by the housing. When the connector is attached to the composite cable, the connection portion pierces the covering portion of a cable corresponding thereto and is connected to the conductor of the cable. The cables include at least one first cable and at least one second cable. The terminals include at least one first terminal corresponding to the at least one first cable and at least one second terminal corresponding to the at least one second cable. The connection portion of the at least one first terminal protrudes from the held portion in the front-rear direction. The connection portion of the at least one second terminal protrudes from the held portion in a perpendicular direction perpendicular to the front-rear direction.

Another aspect of the present invention provides a cable harness having a composite cable and the aforementioned connector attached to the composite cable. The cables include at least one first cable and at least one second cable. The connection portion of the at least one first terminal pierces the covering portion of the at least one first cable and is connected to the conductor of the at least one first cable. The connection portion of the at least one second terminal pierces the covering portion of the at least one second cable and is connected to the conductor of the at least one second cable.

In the connector of the present invention, the terminals include the first terminal corresponding to the first cable and the second terminal corresponding to the second cable. The connection portion of the first terminal protrudes from the held portion of the first terminal in the front-rear direction, and the connection portion of the second terminal protrudes from the held portion of the second terminal in the perpendicular direction. Since the connection portion of the first terminal and the connection portion of the second terminal protrude in different directions, connection of the first terminal to the first cable and connection of the second terminal to the second cable can be carried out separately. This structure of the connector is suitable for automatization of attaching the connector to the composite cable.

An appreciation of the objectives of the present invention and a more complete understanding of its structure may be had by studying the following description of the preferred embodiment and by referring to the accompanying drawings.

Figure 1:
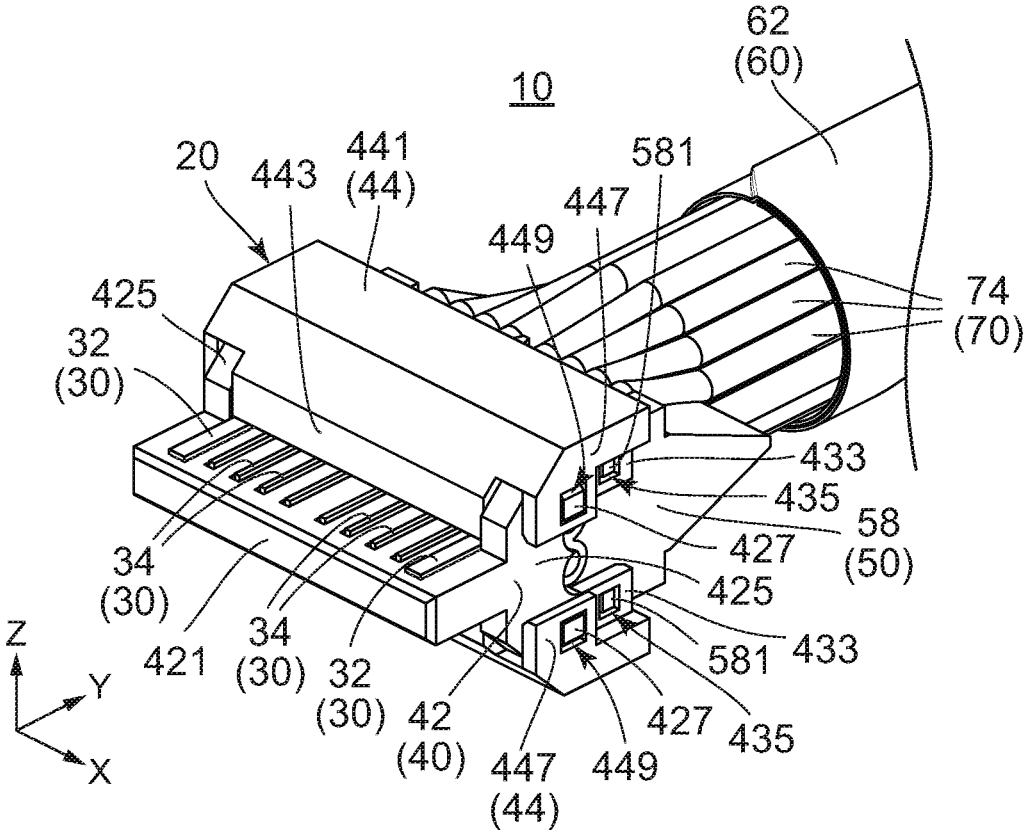
FIG. 1 is a perspective view showing a cable harness according to an embodiment of the present invention. Regarding a composite cable, an end portion thereof is only shown.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a cable harness 10 according to an embodiment of the present invention is provided with a composite cable 60 and a connector 20 attached to an end of the composite cable 60. The composite cable 60 has a plurality of cables 70 and an outer sheath 62 covering the cables 70. The connector 20 is provided with a plurality of terminals 30 corresponding to the cables 70, respectively.

Figure 2:
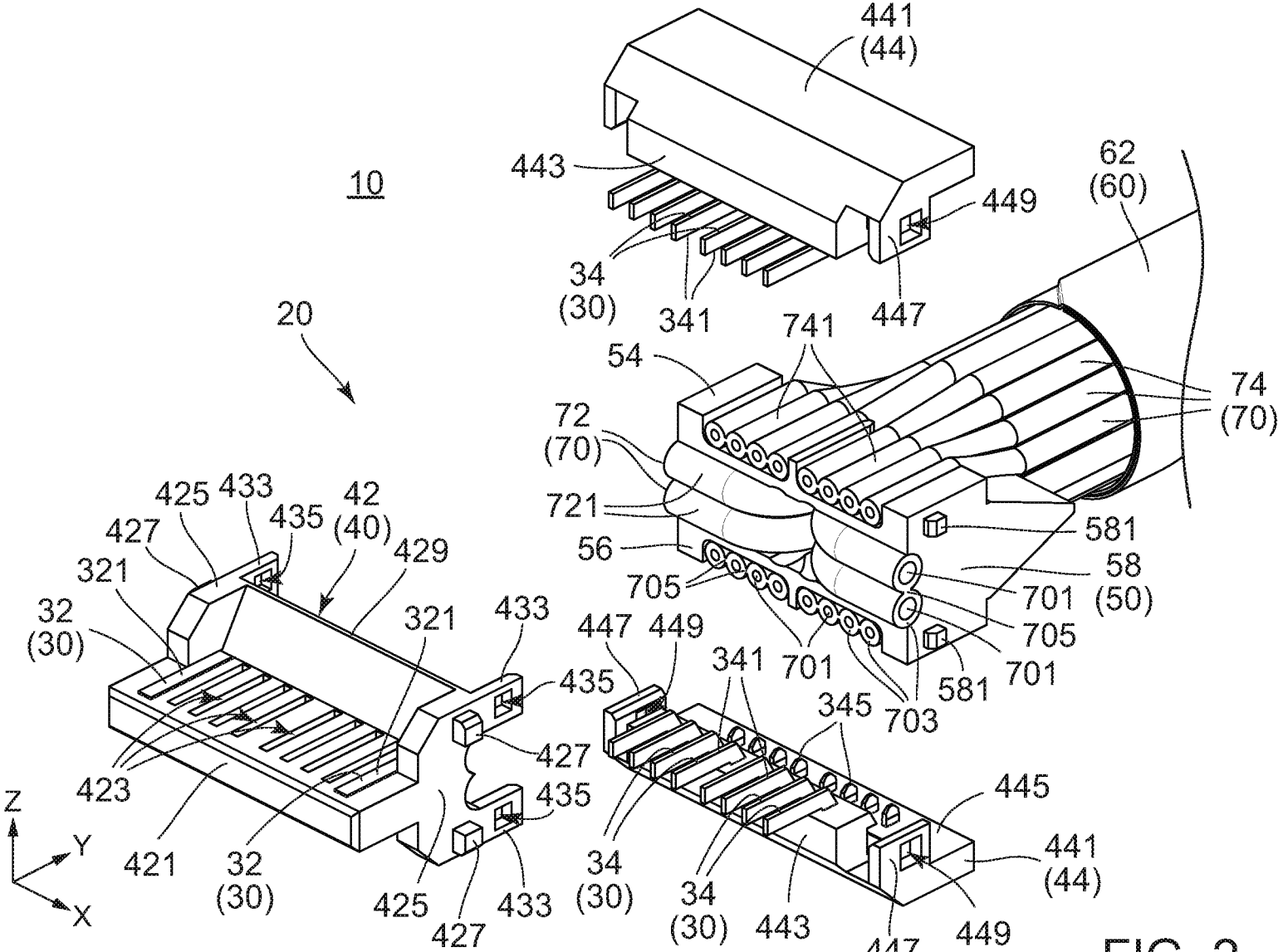
FIG. 2 is an exploded, perspective view showing the cable harness of FIG. 1.

Referring to FIG. 2, the connector 20 is provided with a housing 40 holding the terminals 30 and a locator 50 to which the housing 40 is attached. The housing 40 consists of a first housing 42 and a pair of second housings 44. The first housing 42 is formed so as to be attached to the locator 50. The second housings 44 are formed so as to be combined with the first housing 42. The connector 20 attached to the composite cable 60 is formed by attaching the first housing 42 to the locator 50 and then attaching the second housings 44 to the first housing 42.

Figure 3:
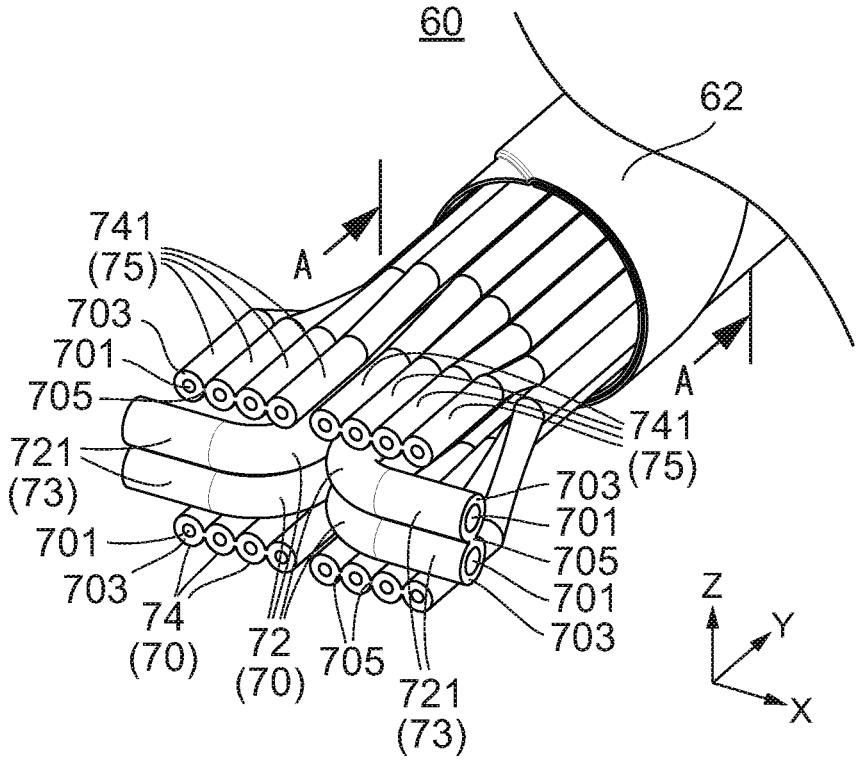
FIG. 3 is a perspective view showing the end portion of the composite cable included in the cable harness of FIG. 2.
Figure 4:
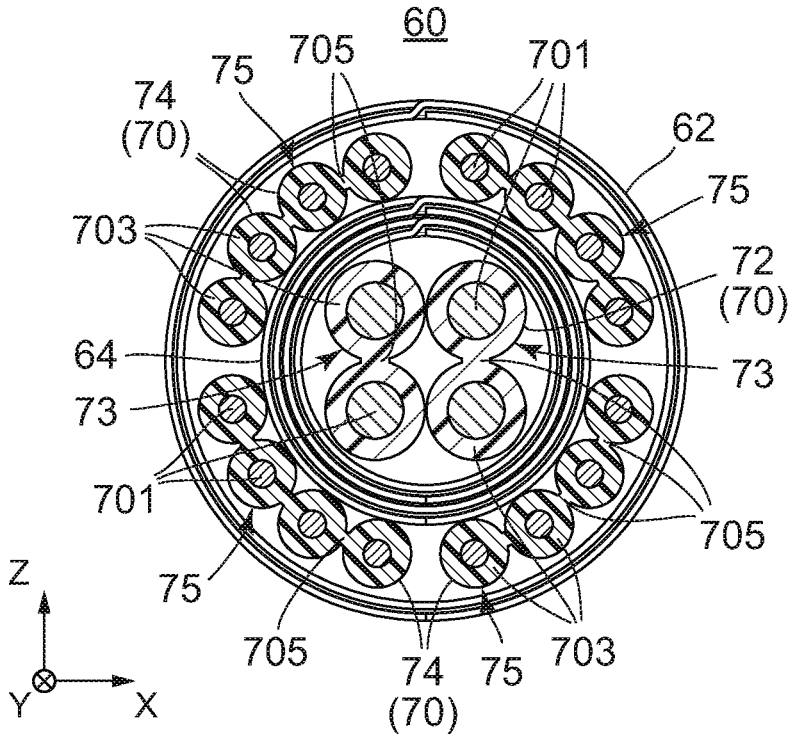
FIG. 4 is a cross-sectional view showing the composite cable of FIG. 3, taken along line A-A.

As shown in FIGS. 2 to 4, the cables 70 include at least one first cable 72 and at least one second cable 74. In the present embodiment, the cables 70 include a plurality of the first cables 72 and a plurality of the second cables 74. Specifically, in the present embodiment, the first cables 72 are four in number, and the second cables 74 are sixteen in number.

As shown in FIG. 2, the terminals 30 include at least one first terminal 32 and at least one second terminal 34. In the present embodiment, the terminals 30 include a plurality of the first terminals 32 and a plurality of the second terminals 34. Specifically, in the preset embodiment, the first terminals 32 are four in number, and the second terminals 34 are sixteen in number. The first terminals 32 correspond to the first cables 72, respectively, and the second terminals 34 correspond to the second cables 74, respectively. Moreover, the first terminals 32 are held by the first housing 42, and the second terminals 34 are held by the second housings 44.

Figure 8:
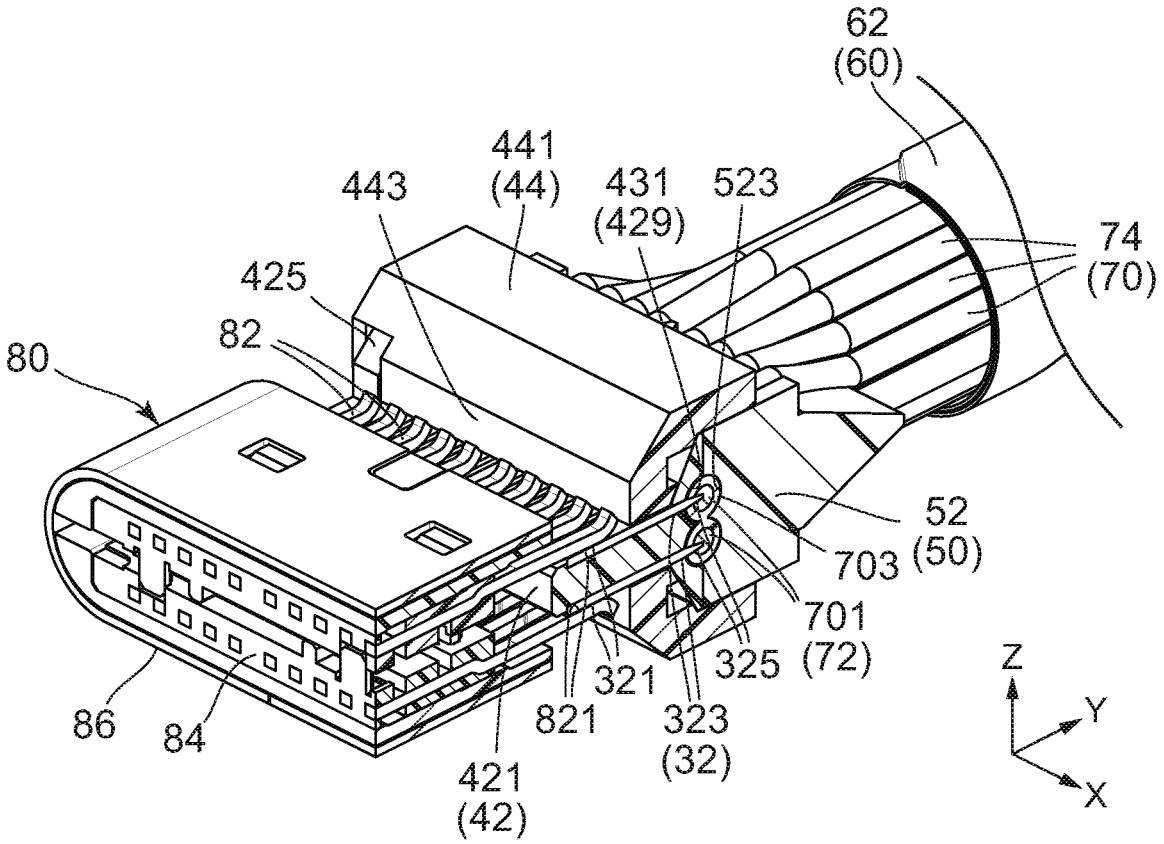
FIG. 8 is a partly cutaway, perspective view showing the cable harness of FIG. 1 and a mating connector. The connector included in the cable harness and the mating connector are mated with each other.
Figure 9:
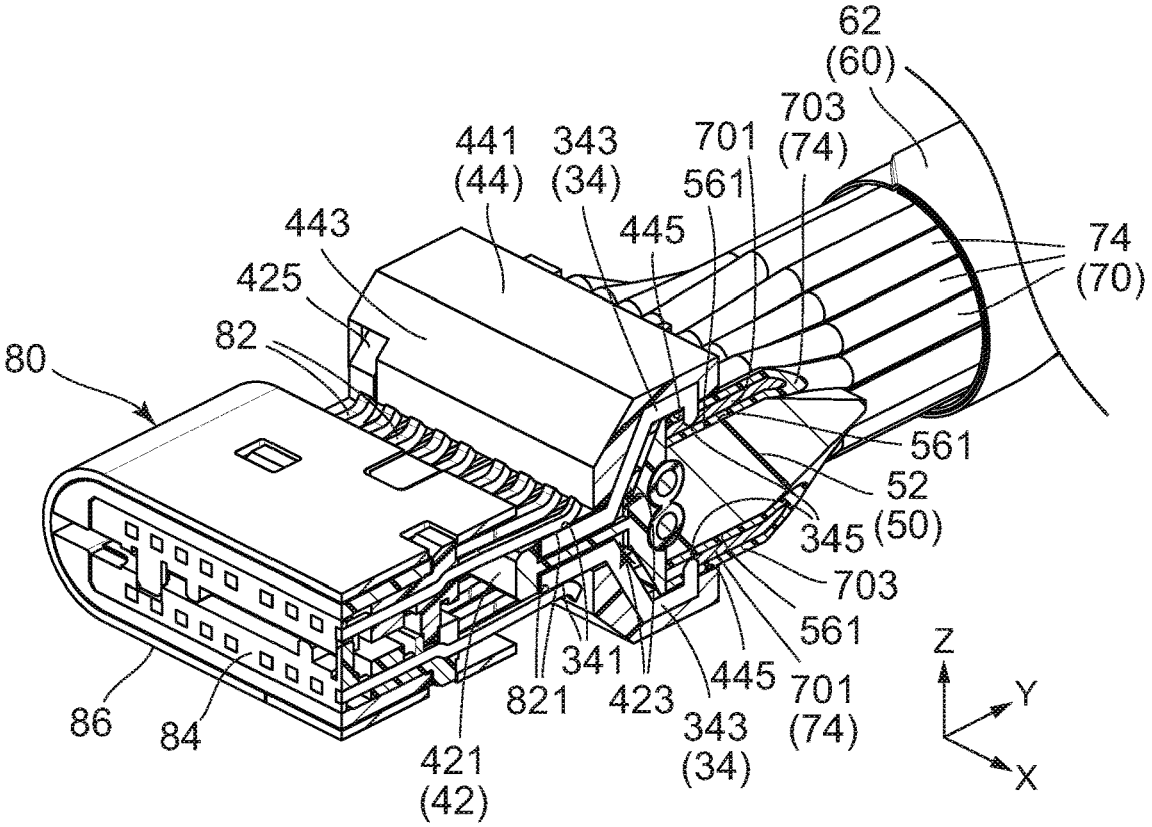
FIG. 9 is another partly cutaway, perspective view showing the cable harness of FIG. 1 and the mating connector. The connector included in the cable harness and the mating connector are mated with each other.

As understood from FIGS. 8 and 9, the connector 20 is connectable to and detachable from a mating connector 80 in a front-rear direction. In the present embodiment, the front-rear direction is a Y-direction. A negative Y-direction is directed forward while a positive Y-direction is directed rearward.

As understood from FIGS. 1, 8 and 9, the mating connector 80 has a plurality of mating terminals 82 corresponding to the terminals 30, respectively. Each of the mating terminals 82 has a mating contact portion 821 which is brought into contact with the terminal 30 corresponding thereto when the mating connector 80 is mated with the connector 20. The mating connector 80 is further provided with a mating housing 84 holding the mating terminals 82 and a mating shell 86 surrounding the mating housing 84.

Referring to FIG. 4, the first cable 72 and the second cable 74 have similar structures. In detail, each of the cables 70 has a conductor 701 and a covering portion 703 covering the conductor 701. In the present embodiment, the conductor 701 is a stranded wire. Moreover, in the present embodiment, the first cable 72 is a power cable, and the second cable 74 is a signal cable. However, the present invention is not limited thereto. The first cable 72 and the second cable 74 may have the same intended uses as each other. But, the first cable 72 and the second cable 74 should be different from each other in at least one of diameter and structure.

As understood from FIGS. 3 and 4, each of the cables 70 is coupled to at least one of the other cables 70 with a coupling portion 705 to form a flat cable. In the present embodiment, the first cables 72 form a plurality of sets of first flat cables 73, and the second cables 74 form a plurality of sets of second flat cables 75. Specifically, in the present embodiment, the sets of the first flat cables 73 are two in number, and the sets of the second flat cables 75 are four in number. However, the present invention is not limited thereto. The first cables 72 may form at least one first flat cable 73 or not form the first flat cable 73. Similarly, the second cables 74 may form at least one second flat cable 75 or not form the second flat cable 75.

As shown in FIG. 4, the first flat cables 73 are arranged in a center portion of the composite cable 60. The second flat cables 75 are arranged around the first flat cables 73. In the present embodiment, between the first flat cables 73 and the second flat cables 75, a middle coating 64 is provided. In other words, the first flat cables 73 are covered by the middle coating 64. However, the present invention is not limited thereto. The middle coating 64 may not be provided.

As shown in FIG. 3, at an end portion of the composite cable 60, the first flat cables 73 and the second flat cables 75 are exposed. In other words, at the end portion of the composite cable 60, the outer sheath 62 is removed. When the composite cable 60 extends in the front-rear direction, end portions of the second flat cables 75 are divided into two groups in a perpendicular direction perpendicular to the front-rear direction. And, end portions of the first flat cables 73 are located between the two groups of the second flat cables 75 in the perpendicular direction. In other words, the end portions of the second flat cables 75 are arranged outward of the end portions of the first flat cables 73 in the perpendicular direction. The end portions of the first flat cables 73 extend outward in a horizontal direction perpendicular to both of the front-rear direction and the perpendicular direction. On the other hand, the end portions of the second flat cables 75 extend forward in the front-rear direction. In the present embodiment, the perpendicular direction is a Z-direction, and the horizontal direction is an X-direction. Additionally, in the present embodiment, a positive Z-direction is directed upward, and a negative Z-direction is directed downward.

Figure 5:
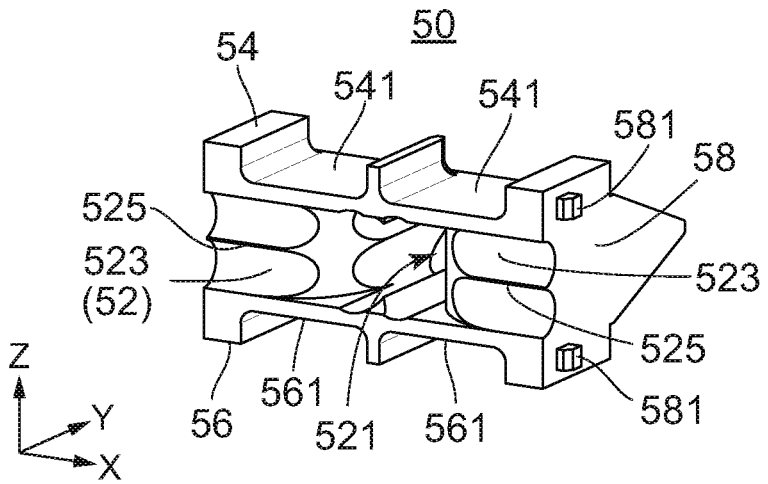
FIG. 5 is a perspective view showing a locator of a connector included in the cable harness of FIG. 2.

Referring to FIG. 5, the locator 50 is made of insulating resin and has a main portion 52, an upper portion 54 and a lower portion 56. The locator 50 has a rotation symmetry shape about an imaginary central axis extending in the front-rear direction. In detail, the locator 50 has a plane symmetry shape about a plane including the imaginary central axis and perpendicular to the perpendicular direction, and it has another plane symmetry shape about another plane including the imaginary central axis and perpendicular to the horizontal direction.

As understood from FIG. 5, the main portion 52 of the locator 50 has a shape long in the horizontal direction. In addition, the main portion 52 has a wedge shape when viewed along the horizontal direction. In a middle portion of the main portion 52, a through hole 521 is formed to pierce the main portion 52 in the front-rear direction. As understood from FIG. 2, the first flat cables 73 are inserted into the through hole 521. Moreover, the main portion 52 divides the second flat cables 75 into the two groups in the perpendicular direction.

As shown in FIG. 5, the main portion 52 of the locator 50 further has a plurality of first arranging portions 523. In the present embodiment, the first arranging portions 523 are four in number. The first arranging portions 523 are curved surfaces extending in the horizontal direction and generally face forward. Between two of the first arranging portions 523 adjacent to each other in the perpendicular direction, a ridge portion 525 is provided. In the present embodiment, the first arranging portions 523 correspond to the first cables 72, respectively. However, the present invention is not limited thereto. The first arranging portions 523 may be altered to recess portions each of which has a flat bottom surface without the ridge portion 525 so as to correspond to one of the first flat cables 73.

As shown in FIG. 5, each of the upper portion 54 of the locator 50 and the lower portion 56 of the locator 50 has a plurality of second arranging portions 541 or 561. In the present embodiment, the second arranging portions 541 of the upper portion 54 are two in number, and the second arranging portions 561 of the lower portion 56 are two in number. In the present embodiment, the second arranging portions 541 and 561 correspond to the second flat cables 75, respectively. However, the present invention is not limited thereto. The second arranging portions 541 and 561 may be altered to portions corresponding to the second cables 74, respectively, as in the case of the first arranging portions 523. Alternatively, the second arranging portions 541 and 561 may be altered to portions each of which corresponds to a plurality of the second flat cables 75.

Figure 10:
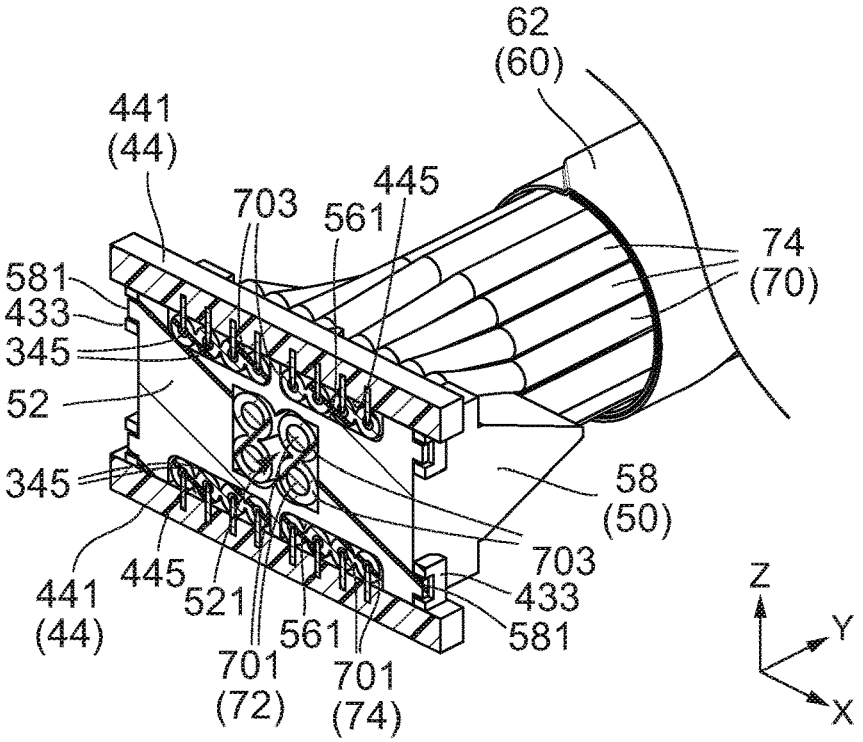
FIG. 10 is a partly cutaway, perspective view showing the cable harness of FIG. 1.
Figure 11:
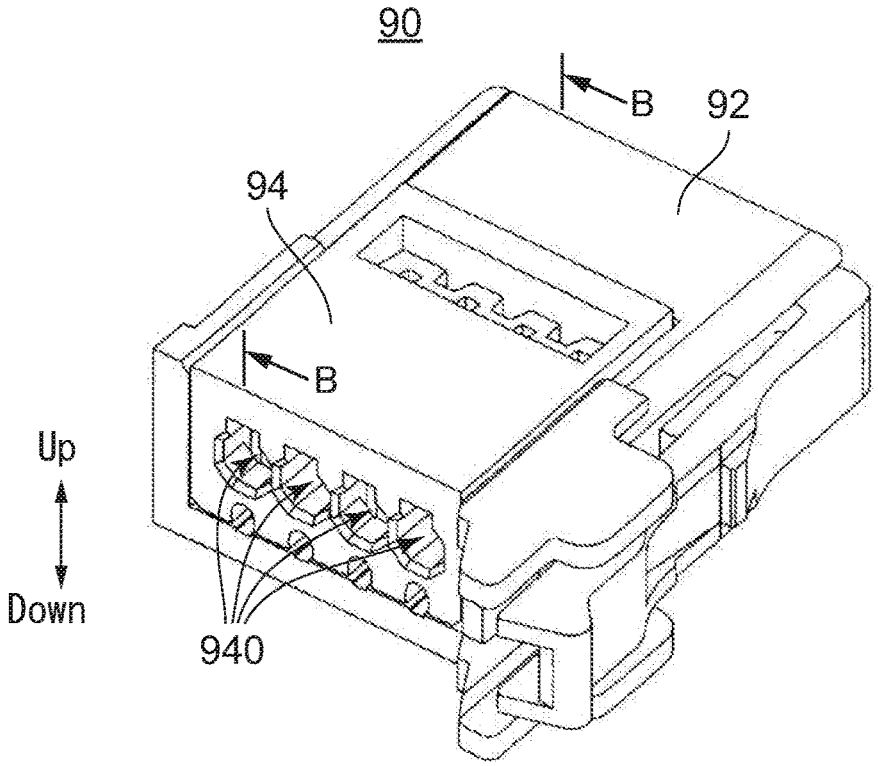
FIG. 11 PRIOR ART
FIG. 11 is a perspective view showing a connector of Patent Document 1.
Figure 12:
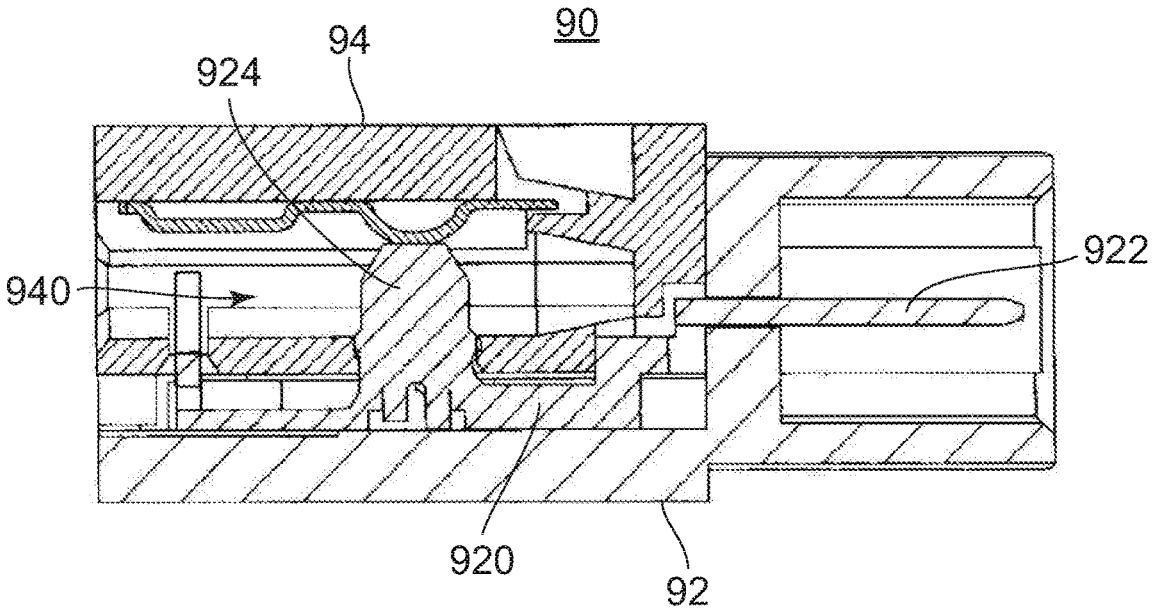
FIG. 12 PRIOR ART
FIG. 12 is a cross-sectional view showing the connector of FIG. 11, taken along line B-B.

As understood from FIGS. 5 and 10, each of side surfaces 58 of the locator 50 is provided with a pair of protrusions 581. The protrusions 581 protrude outward in the horizontal direction. The protrusions 581 on each of the side surfaces 58 are arranged in the perpendicular direction and apart from each other. Each of the protrusions 581 has an inclined surface facing forward diagonally.

As shown in FIG. 2, the locator 50 is attached to the end portion of the composite cable 60. As understood from FIGS. 2 and 5, each of the first cables 72 has a first arranged portion 721 which is received by the first arranging portion 523 corresponding thereto. Moreover, each of the second cables 74 has a second arranged portion 741 which is received by the second arranging portion 541 or 561 corresponding thereto. The first arranged portions 721 of the first cables 72 are received and arranged by the first arranging portions 523, respectively. Similarly, the second arranged portions 741 of the second cables 74 are received and arranged by the second arranging portions 541 and 561.

Figure 6:
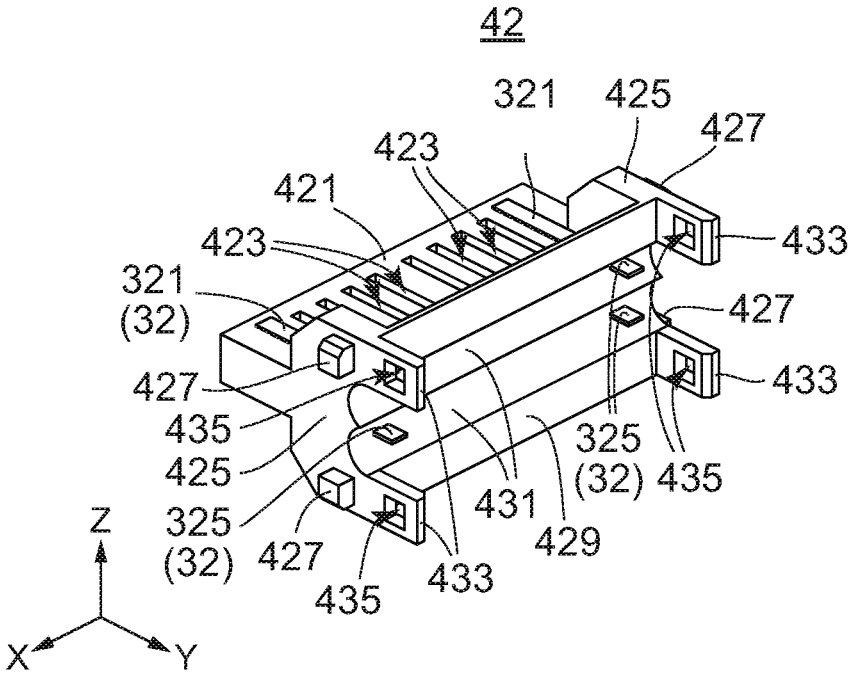
FIG. 6 is a rear, perspective view showing a first housing of the connector included in the cable harness of FIG. 2.

As shown in FIGS. 2 and 6, the first housing 42 is made of insulating resin and provided with a fitting portion 421, a pair of side wall portions 425, a rear wall portion 429 and tabs 433. Moreover, the first housing 42 has a rotation symmetry shape about an imaginary central axis extending in the front-rear direction. In detail, the first housing 42 has a plane symmetry shape about a plane including the imaginary central axis and perpendicular to the perpendicular direction, and it has another plane symmetry shape about another plane including the imaginary central axis and perpendicular to the horizontal direction.

As understood from FIGS. 2 and 6, the first housing 42 holds four of the first terminals 32. As shown in FIG. 8, each of the first terminals 32 is made of a long, narrow metal plate extending in the front-rear direction. Each of the first terminals 32 has a contact portion 321, a held portion 323 and a connection portion 325 in order from a front thereof. The contact portion 321 is brought into contact with the mating contact portion 821 corresponding thereto when the connector 20 is connected to the mating connector 80. The held portion 323 is held by the first housing 42. When the connector 20 is attached to the composite cable 60, the connection portion 325 pierces the covering portion 703 of the first cable 72 corresponding thereto and is connected to the conductor 701 of the first cable 72. The connection portion 325 is tapered so as to be narrower backward. Moreover, the connection portion 325 has a larger size in the horizontal direction than in the perpendicular direction. In other words, the connection portion 325 has the larger size in a direction in which the first arranging portion 721 of the first cable 72 corresponding thereto extends. However, the present invention is not limited thereto. The first terminals 32 may be freely changed in shape and in arrangement, provided that they can be properly connected to the first cables 72.

As shown in FIGS. 2 and 6, the fitting portion 421 has a thick board shape. In an upper surface of the fitting portion 421, the contact portions 321 of two of the first terminals 32 are exposed in part. As understood from FIG. 8, also in a lower surface of the fitting portion 421, the contact portions 321 of other two of the first terminals 32 are exposed in part.

As understood from FIGS. 2, 6 and 9, the fitting portion 421 is formed with a plurality of grooves 423 extending in the front-rear direction. The grooves 423 are formed in the upper surface of the fitting portion 421 and the lower surface of the fitting portion 421. The grooves 423 correspond to the second terminals 34 included in the terminals 30, respectively. The grooves 423 formed in each of the upper surface of the fitting portion 421 and the lower surface of the fitting portion 421 are arranged in the horizontal direction and located between two of the first terminals 32. However, the present invention is not limited thereto. In the horizontal direction, the arrangement order of the first terminals 32 and the grooves 423 may be changed.

As shown in FIGS. 2 and 6, the side wall portions 425 are located at both sides of the fitting portion 421 in the horizontal direction. Moreover, the side wall portions 425 are located at a rear part of the fitting portion 421 in the front-rear direction. Each of the side wall portions 425 is formed with a pair of protrusions 427 protrude outward in the horizontal direction. The protrusions 427 on each of the side wall portions 425 are arranged in the perpendicular direction and apart from each other. Each of the protrusions 427 has an inclined surface which is located outward in the perpendicular direction and which faces upward diagonally or downward diagonally.

As shown in FIGS. 2 and 6, the rear wall portion 429 is located rearward of the fitting portion 421 in the front-rear direction and between the side wall portions 425 in the horizontal direction. As shown in FIG. 6, the rear wall portion 429 is formed with a pair of first facing portions 431. In other words, the first housing 42 has the first facing portions 431. In the present embodiment, each of the first facing portions 431 is a recess extending in the horizontal direction. In other words, each of the first facing portions 431 is a curved surface extending in the horizontal direction and generally facing rearward. However, the present invention is not limited thereto. The first facing portions 431 may be altered to a flat surface. Each of the first facing portions 431 corresponds to two of the first cables 72. From each of the first facing portions 431, the connection portions 325 of two of the first terminals 32 protrude rearward in the front-rear direction.

As shown in FIG. 6, each of the tabs 433 protrudes rearward in the front-rear direction from an upper or a lower part of one of the side wall portions 425. When viewed along the horizontal direction, each of the tabs 433 has a rectangular shape. Each of the tabs 433 is formed with an aperture 435 which has a rectangular shape and which pierces the tab 433 in the horizontal direction.

As understood from FIGS. 2 and 8, the first housing 42 is attached to the locator 50 from a front of the locator 50. As understood from FIGS. 2 and 10, the apertures 435 formed in the tabs 433 of the first housing 42 correspond to the protrusions 581 of the locator 50, respectively. The inclined surfaces of the protrusions 581 facilitate that the tabs 433 are resiliently deformed and ride over the protrusions 581 in part. When the first housing 42 is attached to the locator 50, the protrusions 581 of the locator 50 are received by the apertures 435 of the first housing 42, respectively.

Figure 7:
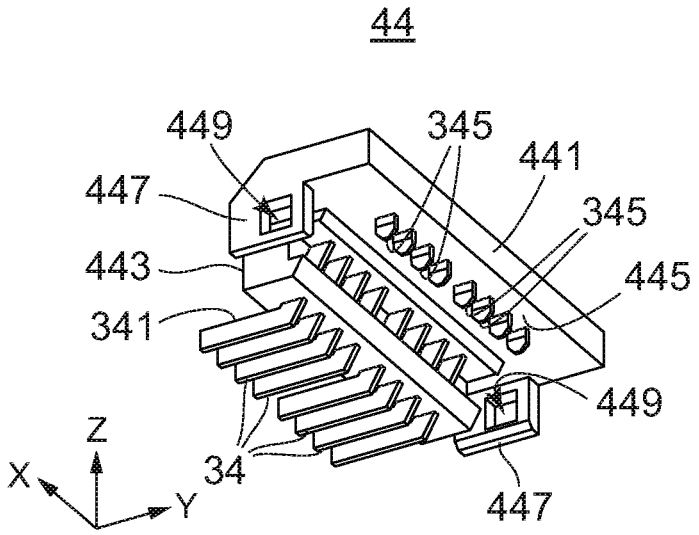
FIG. 7 is a rear, perspective view showing a second housing of the connector included in the cable harness of FIG. 2.

Referring to FIGS. 2 and 7, each of the second housings 44 is made of insulating resin and provided with a base portion 441, a front wall portion 443 and a pair of side wall portions 447. The base portion 441 has a board shape long in the horizontal direction. The base portion 441 further has a second facing portion 445 facing in the perpendicular direction. The front wall portion 443 protrudes from a front edge of the base portion 441 in the perpendicular direction. The second facing portion 445 is located rearward of the front wall portion 443. In the present embodiment, each of the second housings 44 is formed with an inclined surface facing forward diagonally from the base portion 441 to the front wall portion 443. The side wall portions 447 are located outward of the front wall portion 443 in the horizontal direction. The side wall portions 447 are apart from the front wall portion 443. Each of the side wall portions 447 is formed with an opening 449 which pierces the side wall portion 447 in the horizontal direction.

As shown in FIGS. 2 and 7, each of the second housings 44 holds eight of the second terminals 34. Referring to FIG. 9, each of the second terminals 34 is made of a thin metal plate. Each of the second terminals 34 has a contact portion 341, a held portion 343 and a connection portion 345. The contact portion 341 extends in the front-rear direction. The held portion 343 extends rearward diagonally from a rear end of the contact portion 341 and further extends rearward. The connection portion 345 protrudes from a rear end of the held portion 343 in the perpendicular direction. The connection portion 345 is tapered. Moreover, the connection portion 345 has a larger size in the front-rear direction than in the horizontal direction. In other words, the connection portion 345 has the larger size in a direction in which the second arranged portions 741 of the second cables 74 extend.

As understood from FIG. 9, the contact portion 341 of the second terminal 34 is brought into contact with the mating contact portion 821 corresponding thereto when the connector 20 is connected to the mating connector 80. The held portion 343 is held by the second housing 44. As understood from FIG. 7, in the present embodiment, the held portion 343 is held by the front wall portion 443 in part and held by the base portion 441 in part. As shown in FIGS. 9 and 10, when the connector 20 is attached to the composite cable 60, the connection portion 345 pierces the covering portion 703 of the second cable 74 corresponding thereto and is connected to the conductor 701 of the second cable 74. As shown in FIGS. 1 and 7, the connection portion 345 protrudes from the second facing portion 445 of the base portion 441 of the second housing 44 in the perpendicular direction.

As shown in FIG. 9, in the present embodiment, each of the second terminals 34 has a flat shape. However, the present invention is not limited thereto. Each of the second terminals 34 may have one or more bent portions. For example, the second terminal 34 may be provided with bent portions so that the contact portion 341 thereof and the connection portion 345 thereof are positioned at different positions in the horizontal direction. This allows changing arrangement order of the first terminals 32 and the contact portions 341 of the second terminals 34 in the horizontal direction. Alternatively, the second terminal 34 may be provided with bent portions so that a thickness direction of the contact portion 341 thereof coincides with the perpendicular direction. This allows increasing contact area where the contact portion 341 is brought into contact with the mating contact portion 821 corresponding thereto.

As understood from FIGS. 2 and 8 to 10, the second housings 44 are combined with the first housing 42 from above and beneath the first housing 42, respectively. As understood from FIGS. 1 and 2, the protrusions 427 of the first housing 42 correspond to the openings 449 of the second housings 44, respectively. The inclined surfaces of the protrusions 427 facilitate that the side wall portions 447 of the second housings 44 are resiliently deformed and ride over the protrusions 427 in part. When the second housings 44 are attached to the first housing 42, the protrusions 427 of the first housing 42 are received by the openings 449 of the second housings 44, respectively. At this time, each of the second terminals 34 is partly accommodated in the groove 423, which corresponds thereto, of the first housing 42. Moreover, each of the side wall portions 425 of the first housing 42 is positioned between the front wall portion 443 of each of the second housings 44 and the side wall portion 447 of the second housing 44 in part.

As understood from FIGS. 2, 6 and 8, in a state that the housing 40 and the locator 50 are combined with each other, each of the first facing portions 431 of the first housing 42 faces two of the first arranging portions 523 of the locator 50 in the front-rear direction. Moreover, each of the connection portions 325 of the first terminals 32 protrudes from one of the first facing portions 431 toward one of the first arranging portion 523 along the front-rear direction and is positioned between the first facing portion 431 and the first arranging portion 523 in the front-rear direction. As a result, when the connector 20 is attached to the composite cable 60, each of the first arranged portions 721 of the first cables 72 is sandwiched between one of the first facing portions 431 and one of the first arranging portions 523 so as to extend in the horizontal direction. Moreover, the connection portions 325 of the first terminals 32 pierce the covering portions 703 of the first cables 72 and are connected to the conductors 701 of the first cables 72, respectively.

As understood from FIGS. 2, 7, 9 and 10, in the state that the housing 40 and the locator 50 are combined with each other, each of the second facing portions 445 of the second housings 44 faces the second arranging portions 541 or 561 of the locator 50 in the perpendicular direction. Moreover, each of the connection portions 345 of the second terminals 34 protrudes from one of the second facing portions 445 toward one of the second arranging portions 541 and 561 in the perpendicular direction and is positioned between the second facing portion 445 and the second arranging portion 541 or 561 in the perpendicular direction. As a result, when the connector 20 is attached to the composite cable 60, each of the second arranged portions 741 of the second cables 74 is sandwiched between one of the second facing portions 445 and one of the second arranging portions 541 and 561 so as to extend in the front-rear direction. Moreover, the connection portions 345 of the second terminals 34 pierce the covering portions 703 of the second cables 74 and are connected to the conductors 701 of the second cables 74, respectively. As understood from FIGS. 8 and 9, in the present embodiment, the connection portions 325 of the first terminals 32 are positioned forward of the connection portions 345 of the second terminals 34 in the front-rear direction. However, the present invention is not limited thereto. In the front-rear direction, the position of the connection portions 325 of the first terminals 32 and the position of the connection portions 345 of the second terminals 34 can be changed by changing at least one of the housing 40 and the locator 50 in shape.

The connector 20 according to the present embodiment can connect the first terminals 32 to the first cables 72 corresponding to the first terminals 32 by moving the first housing 42 in a direction for the locator 50. Moreover, the connector 20 can connect the second terminals 34 to the second cables 74 corresponding to the second terminals 34 by moving each of the second housings 44 in another direction for the first housing 42. Thus, connection to the first cables 72 and connection to the second cables 74 can be separately carried out by simple processes. Therefore, the connector 20 according to the present embodiment is suitable for automatization of being attached to the composite cable 60.

Although the specific explanation about the present invention is made above referring to the embodiments, the present invention is not limited thereto but susceptible of various modifications and alternative forms without departing from the spirit of the invention. For example, although the connector 20 according to the aforementioned embodiment is connectable to and detachable from the mating connector 80, the connector 20 may be formed to connect between a composite cable and a connector portion similarly to a paddle card used in a universal serial bus (USB) type-C connector.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector to be attached to a composite cable having a plurality of cables, wherein:

the connector is connectable to and detachable from a mating connector having mating contact portions along a front-rear direction;

the connector comprises a plurality of terminals and a housing;

the terminals correspond to the cables, respectively;

each of the cables has a conductor and a covering portion covering the conductor;

each of the terminals has a contact portion, a held portion and a connection portion;

the contact portion is brought into contact with one of the mating contact portions when the connector is connected to the mating connector;

the held portion is held by the housing;

when the connector is attached to the composite cable, the connection portion pierces the covering portion of a cable corresponding thereto and is connected to the conductor of the cable;

the cables include at least one first cable and at least one second cable;

the terminals include at least one first terminal corresponding to the at least one first cable and at least one second terminal corresponding to the at least one second cable;

the connection portion of the at least one first terminal protrudes from the held portion in the front-rear direction; and the connection portion of the at least one second terminal protrudes from the held portion in a perpendicular direction perpendicular to the front-rear direction.

2. A cable harness having a composite cable and the connector as recited in claim 1, the connector being attached to the composite cable, wherein:

the cables include at least one first cable and at least one second cable;

the connection portion of the at least one first terminal pierces the covering portion of the at least one first cable and is connected to the conductor of the at least one first cable; and the connection portion of the at least one second terminal pierces the covering portion of the at least one second cable and is connected to the conductor of the at least one second cable.

3. The cable harness as recited in claim 2, wherein:

the at least one first cable comprises a plurality of first cables;

the first cables form a plurality sets of first flat cables;

the at least one second cable comprises a plurality of second cables;

the second cables form a plurality of sets of second flat cables; and in the composite cable, the second flat cables are arranged around the first flat cables.

4. The connector as recited in claim 1, wherein:

the housing comprises a first housing and a second housing which is combined with the first housing;

the at least one first terminal is held by the first housing; and the at least one second terminal is held by the second housing.

5. A cable harness having a composite cable and the connector as recited in claim 4, the connector being attached to the composite cable, wherein:

the cables include at least one first cable and at least one second cable;

the connection portion of the at least one first terminal pierces the covering portion of the at least one first cable and is connected to the conductor of the at least one first cable; and the connection portion of the at least one second terminal pierces the covering portion of the at least one second cable and is connected to the conductor of the at least one second cable.

6. The cable harness as recited in claim 5, wherein:

the at least one first cable comprises a plurality of first cables;

the first cables form a plurality sets of first flat cables;

the at least one second cable comprises a plurality of second cables;

the second cables form a plurality of sets of second flat cables; and in the composite cable, the second flat cables are arranged around the first flat cables.

7. The connector as recited in claim 1, wherein:

the connector further comprises a locator;

the at least one first cable comprises a plurality of first cables;

the at least one second cable comprises a plurality of second cables;

the at least one first terminal comprises a plurality of first terminals;

the at least one second terminal comprises a plurality of second terminals;

each of the first cables has a first arranged portion;

each of the second cables has a second arranged portion;

the locator has a first arranging portion and a second arranging portion;

the housing has a first facing portion and a second facing portion;

in a state that the housing and the locator are combined with each other, the first facing portion faces the first arranging portion in the front-rear direction, and the connection portions of the first terminals protrude from the first facing portion toward the first arranging portion along the front-rear direction;

in the state that the housing and the locator are combined with each other, the second facing portion faces the second arranging portion in the perpendicular direction, and the connection portions of the second terminals protrude from the second facing portion toward the second arranging portion along the perpendicular direction;

when the connector is attached to the composite cable, the first arranged portions of the first cables are sandwiched between the first arranging portion and the first facing portion to extend in a horizontal direction perpendicular to both of the front-rear direction and the perpendicular direction; and when the connector is attached to the composite cable, the second arranged portions of the second cables are sandwiched between the second arranging portion and the second facing portion to extend in the front-rear direction.

8. A cable harness having a composite cable and the connector as recited in claim 7, the connector being attached to the composite cable, wherein:

the cables include at least one first cable and at least one second cable;

the connection portion of the at least one first terminal pierces the covering portion of the at least one first cable and is connected to the conductor of the at least one first cable; and the connection portion of the at least one second terminal pierces the covering portion of the at least one second cable and is connected to the conductor of the at least one second cable.

9. The cable harness as recited in claim 8, wherein:

the at least one first cable comprises a plurality of first cables;

the first cables form a plurality sets of first flat cables;

the at least one second cable comprises a plurality of second cables;

the second cables form a plurality of sets of second flat cables; and in the composite cable, the second flat cables are arranged around the first flat cables.

10. The connector as recited in claim 7, wherein:

the connection portion of the first terminal has a larger size in the horizontal direction than in the perpendicular direction; and the connection portion of the second terminal has a larger size in the front-rear direction larger than in the horizontal direction.

11. A cable harness having a composite cable and the connector as recited in claim 10, the connector being attached to the composite cable, wherein:

the cables include at least one first cable and at least one second cable;

the connection portion of the at least one first terminal pierces the covering portion of the at least one first cable and is connected to the conductor of the at least one first cable; and the connection portion of the at least one second terminal pierces the covering portion of the at least one second cable and is connected to the conductor of the at least one second cable.

12. The cable harness as recited in claim 11, wherein:

the at least one first cable comprises a plurality of first cables;

the first cables form a plurality sets of first flat cables;

the at least one second cable comprises a plurality of second cables;

the second cables form a plurality of sets of second flat cables; and in the composite cable, the second flat cables are arranged around the first flat cables.

* * * * *